US010800028B2

(12) United States Patent
Jentzmyk

(10) Patent No.: US 10,800,028 B2
(45) Date of Patent: Oct. 13, 2020

(54) PUNCH DEVICE FOR MARKING DRILLED HOLES

(71) Applicant: Alexander Jentzmyk, Biberach (DE)

(72) Inventor: Alexander Jentzmyk, Biberach (DE)

( * ) Notice: Subject to any disclaimer, the term of this patent is extended or adjusted under 35 U.S.C. 154(b) by 36 days.

(21) Appl. No.: 15/916,313

(22) Filed: Mar. 9, 2018

(65) Prior Publication Data

US 2018/0257252 A1 Sep. 13, 2018

(30) Foreign Application Priority Data

Mar. 10, 2017 (DE) ..... 10 2017 105 091
Mar. 8, 2018 (EP) ..... 18160729

(51) Int. Cl.

| | |
|---|---|
| ***B25H 7/04*** | (2006.01) |
| ***B26F 1/32*** | (2006.01) |
| ***B25D 5/02*** | (2006.01) |
| ***B26F 1/04*** | (2006.01) |
| ***B26F 1/40*** | (2006.01) |
| ***B26F 1/44*** | (2006.01) |
| *B21D 28/26* | (2006.01) |
| *B21D 28/34* | (2006.01) |

(52) U.S. Cl.

CPC ..... *B25H 7/045* (2013.01); *B25D 5/02* (2013.01); *B26F 1/04* (2013.01); *B26F 1/32* (2013.01); *B26F 1/40* (2013.01); *B26F 1/44* (2013.01); *B21D 28/26* (2013.01); *B21D 28/343* (2013.01); *B25D 2250/381* (2013.01)

(58) Field of Classification Search

CPC ..... B26F 1/40; B26F 1/04; B26F 1/32; B26F 1/44; B25D 5/02; B25D 2250/381; B25H 7/045; B25H 7/04; B25H 2250/381; B21D 28/26; B21D 28/343

USPC ..... 30/358, 360, 362, 366–368

See application file for complete search history.

(56) References Cited

U.S. PATENT DOCUMENTS 2,708,972 A * 5/1955 Park ..... B25D 5/00 30/367
2,744,329 A * 5/1956 Way ..... B25H 7/045 33/18.1

(Continued)

FOREIGN PATENT DOCUMENTS

DE 8333774 U1 3/1984

*Primary Examiner* — Phong H Nguyen

(74) *Attorney, Agent, or Firm* — Bachman & LaPointe, P.C.

(57) ABSTRACT

In a punch device (100) with a marking element (110) for marking drilled holes to be applied with positional accuracy for the purpose of the positionally accurate positioning of an object to be attached to a wall (200), in situ correctable and thus accurately definable marking of drilled holes to be inserted into a wall (200) for the attachment of objects to the wall (200) is achieved in that the marking element (110) at least for the most part is reciprocally mounted inside a housing (120), which is provided with a front positioning element (130) close to the wall provided with a central opening (131) for mounting a supporting element (150) connected to the marking element (110) for positioning the punch device (100) on a wall (200), as well as with a mounting element (140) provided with a drilled hole (141) for mounting a supporting element (150) connected to the marking element (110), which mounting element has a means for the releasable attachment of the punch device (100) to the object to be attached to the wall (200).

5 Claims, 11 Drawing Sheets

(56) References Cited

U.S. PATENT DOCUMENTS

| | | | | |
|---|---|---|---|---|
| 5,791,056 | A * | 8/1998 | Messina | A62B 3/005 30/361 |
| 2006/0117577 | A1 * | 6/2006 | King | B26F 1/32 30/368 |
| 2006/0236552 | A1 * | 10/2006 | Giles | B26F 1/32 30/366 |

* cited by examiner

PUNCH DEVICE FOR MARKING DRILLED HOLES

The invention relates to a punch device with a marking element for marking drilled holes to be applied with positional accuracy for the purpose of the positionally accurate positioning of an object to be attached to a wall. In particular pictures, mirrors, telephone systems and telephones, routers, W-LAN transmitters or monitor brackets can be considered as objects in this case.

Punch devices of the kind mentioned by way of introduction are familiar in the prior art only in the form of less suitable and awkwardly applied auxiliary means. The familiar punch devices thus all have the disadvantage that an in situ correctable and thus accurately definable marking of drilled holes to be positioned on a wall for the positioning or hanging of objects such as pictures, mirrors or monitors on a wall is not facilitated.

The object of the invention is therefore to propose a punch device, by means of which an easily implemented and in situ correctable and thus accurately definable marking of nails or drilled holes to be inserted into a wall for the positioning or hanging of objects such as pictures, mirrors, telephone systems and telephones, routers, W-LAN transmitters or, for example, also monitor brackets on a wall is facilitated.

For a punch device of the kind mentioned by way of introduction, this object is accomplished according to a first feature of the present invention in that the marking element is transferable reciprocally from a first position, in which the marking element is arranged remotely from the wall, into a second position, in which a front part of the marking element close to the wall makes contact with a point on the wall for the purpose of producing a mark.

Preferred embodiments of this feature of the invention have elements that act for the purpose of a further improvement in the approach to finding a solution to the underlying object of the invention.

In the inventive punch device according to the first feature of the present invention, an easily implemented and in situ correctable and thus accurately definable marking of drilled holes to be positioned on a wall for the positioning of objects on a wall by simple pressing of the object against the wall is achieved with the help of the combination of characterizing features, in that the marking element is transferable reciprocally from a first position, in which the marking element is arranged remotely from the wall, into a second position, in which a front part of the marking element close to the wall makes contact with a point on the wall for the purpose of producing a mark.

Pressing of an object in question against the force of the spring device in the direction of the wall in this case causes a movement of the supporting element and of the marking element connected or attached to the supporting element from a first position, in which the marking element at least for the most part is arranged inside the housing, into a second position, in which at least a front part of the marking element close to the wall protrudes from the housing for the purpose of contacting a point on the wall and marks the point in question on the wall, at which a nail is to be positioned or a drilled hole for the introduction of a screw or a dowel for the attachment of an object in question to the wall is to be inserted into the wall.

According to a first preferred embodiment of the inventive punch device according to the first feature of the present invention, it is proposed that the marking element is anchored to a carrier element connected to a carrier frame, wherein the carrier element is transportable from the first position into the second position against the force of a spring.

According to a significant preferred embodiment of the inventive punch device, the spring is configured as a helical spring, wherein an end of the helical spring remote from the wall is supported on the carrier frame.

Furthermore, the carrier element preferably forms a cylindrical platform arranged on the carrier frame, wherein the marking element is arranged at the center of an end face of the carrier element close to the wall, and an end face of the carrier element remote from the wall is connected securely to the carrier frame, and wherein the outer surface of the carrier element together with the annular free surface of the likewise cylindrically shaped carrier frame close to the wall forms a support for the end of the helical spring remote from the wall.

According to a further significant preferred embodiment of the inventive punch device, the helical spring is formed by a helically wound flat strip, one end of which is supported on the carrier frame and the other end of which forms an end face for positioning the punch device on a wall.

A particularly advantageous embodiment is achieved if the flat strip is of undulating configuration and in this case exhibits a definable elasticity.

In the course of a helical winding through 360° a plurality of successive wave crests and wave troughs are provided, wherein each wave crest of a first winding comprising 360° faces an associated wave trough of a neighboring second winding comprising 360°, and each wave trough of a first winding comprising 360° faces an associated wave crest of a neighboring second winding comprising 360°, in order to obtain an elastic compressibility at a prescribed length of the helical spring (14) by means of the undulation of the flat strip in this case.

For the purpose of a practical execution, in particular four successive wave crests and wave troughs are provided in the course of a helical winding through 360°.

Furthermore, the carrier element is preferably configured in a single piece with the carrier frame.

According to a further preferred embodiment of the inventive punch device according to the first feature of the present invention, an undersurface of the cylindrically shaped carrier frame forms a pressing surface for pressing the carrier element against a wall by hand.

A central drilled hole provided with an internal thread can preferably be configured in the region of the undersurface of the carrier frame, into which drilled hole a knurled screw provided with an external thread containing a projecting part of a disk is introduced, wherein a distance from the disk to the undersurface of the carrier frame is adjustable by rotation of the knurled screw by hand.

Regions of the disk of the knurled screw remote from the projecting part are preferably provided with a plurality of indentations, in order to permit an easier manual grip.

The disk of the knurled screw preferably has a central drilled hole provided with an internal thread, into which an adjusting screw is introduced, and a compressible, elastic silicon tube is arranged between an undersurface of the disk and a head of the adjusting screw, wherein a distance from the head of the adjusting screw to the undersurface of the disk and thus the extent of a compression of the silicon tube is preferably adjustable by rotation of the adjusting screw by hand.

The inventive punch device according to the second feature of the present invention is explained below.

For a punch device of the kind mentioned by way of introduction, the underlying object of the invention according to the second feature of the present invention is accomplished in that the marking element at least for the most part is reciprocally mounted inside a housing, which is provided with a front positioning element provided with a central opening close to the wall for positioning the punch device on a wall, as well as with a mounting element provided with a drilled hole for mounting a supporting element connected to the marking element, which has a means for the releasable attachment of the punch device to the object to be attached to the wall.

Preferred embodiments of the invention according to the second feature have elements that act for the purpose of a further improvement in the approach to finding a solution of the underlying object of the invention.

In the inventive punch device according to the second feature of the present invention, an easily implemented and in situ correctable and thus accurately definable marking of drilled holes to be positioned on a wall for the positioning of objects on a wall by simple pressing of the object against the wall is achieved with the help of the combination of characterizing features, in that the marking element at least for the most part is reciprocally mounted inside a housing, which is provided with a front positioning element provided with a central opening close to the wall for positioning the punch device on a wall as well as with a mounting element provided with a drilled hole for mounting a supporting element connected to the marking element, which has a means for the releasable attachment of the punch device to the object to be attached to the wall.

Pressing of an object in question, positioned behind the punch device remotely from the wall against the punch device and as a result transmitted against the force of the spring device in the direction of the wall as a result brings about a movement of the supporting element and of the marking element connected or attached to the supporting element from a first position, in which the marking element is arranged at least for the most part inside the housing, into a second position, in which at least a front part of the marking element close to the wall protrudes from the housing for the purpose of contacting a point on the wall and marks the point in question on the wall. A nail is then positioned at the marked point in question, or a drilled hole for the introduction of a screw or of a dowel for the attachment of an object in question to the wall is inserted into the wall.

According to a first preferred embodiment of the inventive punch device according to the second feature, it is proposed that the supporting element connected to the marking element is transportable from a first position, in which the marking element at least for the most part is arranged inside the housing, into a second position, in which at least a front part of the marking element close to the wall is led through the central opening of the positioning element and protrudes from the housing for the purpose of contacting a point on the wall.

The supporting element in this case is preloaded into the first position preferably by means of a spring device interacting with a rear surface of the positioning element and is transportable into the second position by pressing the supporting element against the force of the spring device.

According to another preferred embodiment of the inventive punch device, the supporting element is of bolt-shaped configuration, wherein the marking element is securely connected to the supporting element in the region of a front end face of the supporting element close to the wall.

In addition, the supporting element in the region of the rear end face facing the front end face preferably has an attachment body as means for the releasable attachment of the supporting element to the object to be attached to the wall. The attachment body in this case can be formed, for example, by a projecting part positioned in the region of the rear end face of the retaining device, which is provided with a flange for the engagement of the punch device in a cut-out recess of the object to be attached.

According to a significant preferred embodiment of the inventive punch device according to the second feature of the present invention, the supporting element in the region of its front end face has a flange, of which the rear surface remote from the marking element is supported in the first position of the supporting element on the internal surface of a wall of the mounting element close to the drilled hole, configured as an internal flange.

According to a further significant preferred embodiment of the inventive punch device according to the second feature of the present invention, the positioning element is formed by a supporting panel of flat configuration, wherein the front side of the flange of the supporting element adjoins a rear surface of the supporting panel at least indirectly in the second position of the supporting element.

The housing is preferably of hollow cylindrical configuration and is provided in the region of the internal surface of the cylinder surface in question with an internal thread, wherein the mounting element is provided with an external thread corresponding to the internal thread of the housing, in order to connect the mounting element releasably to the housing using the supporting element.

The spring device is preferably, although not necessarily, formed by an elastic annular spring, which can be embodied as a spiral spring, a finger spring or a hexagonal spring.

For the configuration of a particular, non-mechanical and, in this respect, wear-free spring device, a magnet provided with a central opening as passage for the reciprocally mounted marking element can be positioned respectively in the region of the rear surface of the supporting panel and in the region of the front side of the flange of the supporting element, wherein the opposing end faces of the two magnets have the same pole designation in order to produce a mutually repelling force forming the spring device.

According to a conventional embodiment of the inventive punch device, the marking element is formed by a felt-tipped marker, of which the tip is configured in order, in a second position of the supporting element, to apply a marking point to a wall, which determines the point on the wall at which a drilled hole is to be inserted into the wall for the introduction of a screw or of a dowel for the attachment of an object in question to the wall.

According to a particular embodiment of the inventive punch device, adapted in particular for a soft wooden wall, the marking element is formed by a metallic cone body, of which the tip is configured in order, in a second position of the supporting element, to insert a hole into a wall, which determines the point on the wall, at which a drilled hole for the introduction of a screw or of a dowel for the attachment of an object in question to the wall is to be inserted into the wall.

The inventive punch device is explained below on the basis of preferred embodiments, which are represented in the figures of the drawing. In the drawing.

Figure 1:
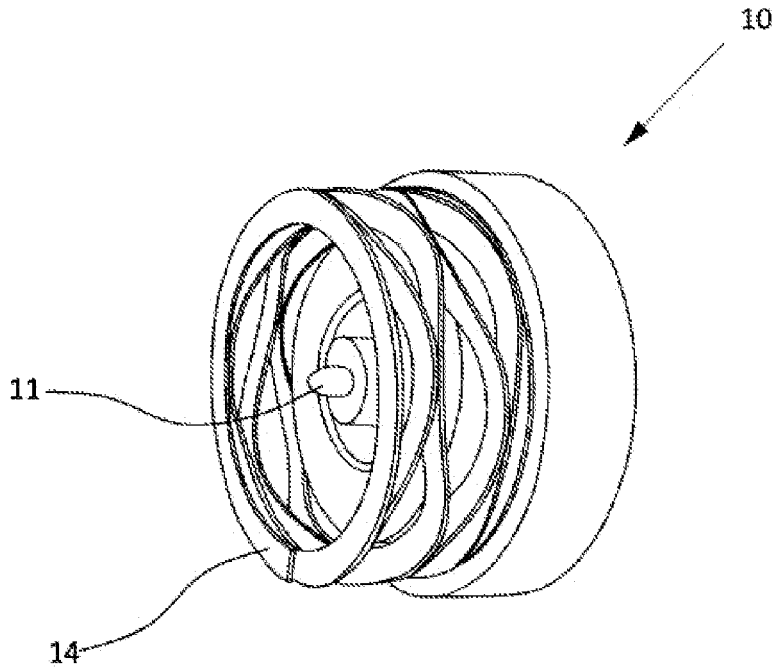
FIG. 1 depicts a preferred embodiment of the punch device according to the first feature of the present invention in an oblique view from the front.
Figure 2:
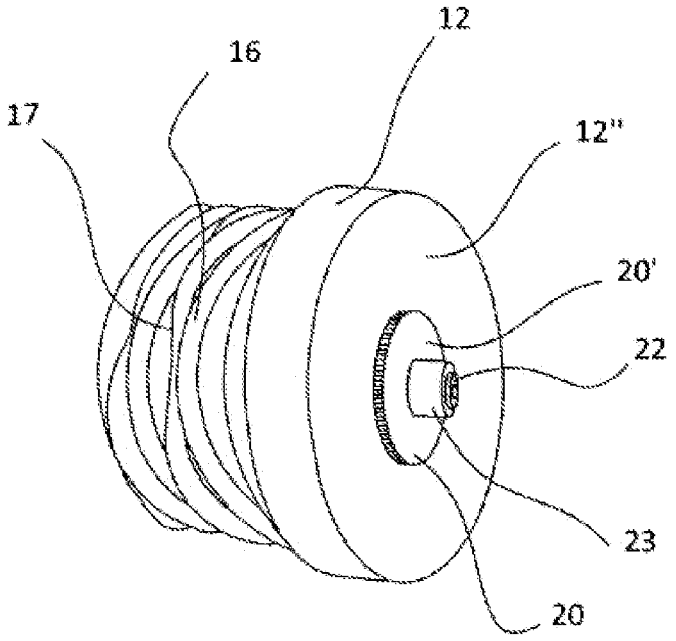
FIG. 2 depicts the punch device represented in FIG. 1 in an oblique view from the rear.
Figure 3:
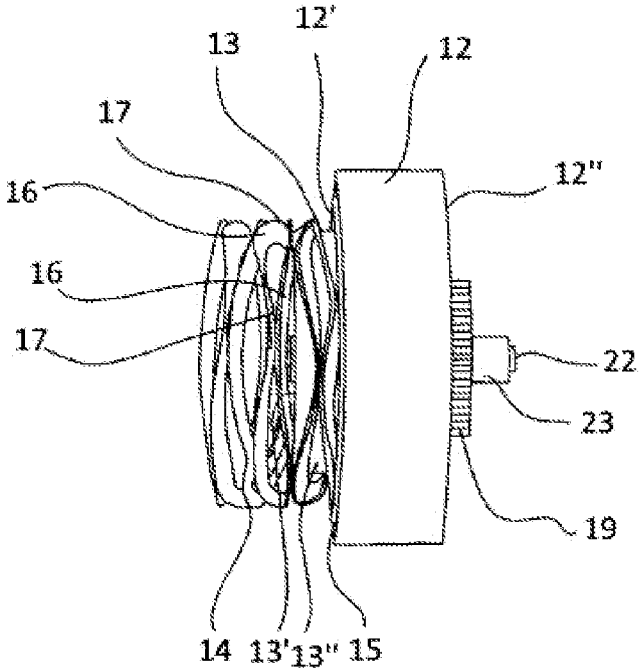
FIG. 3 depicts the punch device represented in FIG. 1 in a side view.
Figure 4:
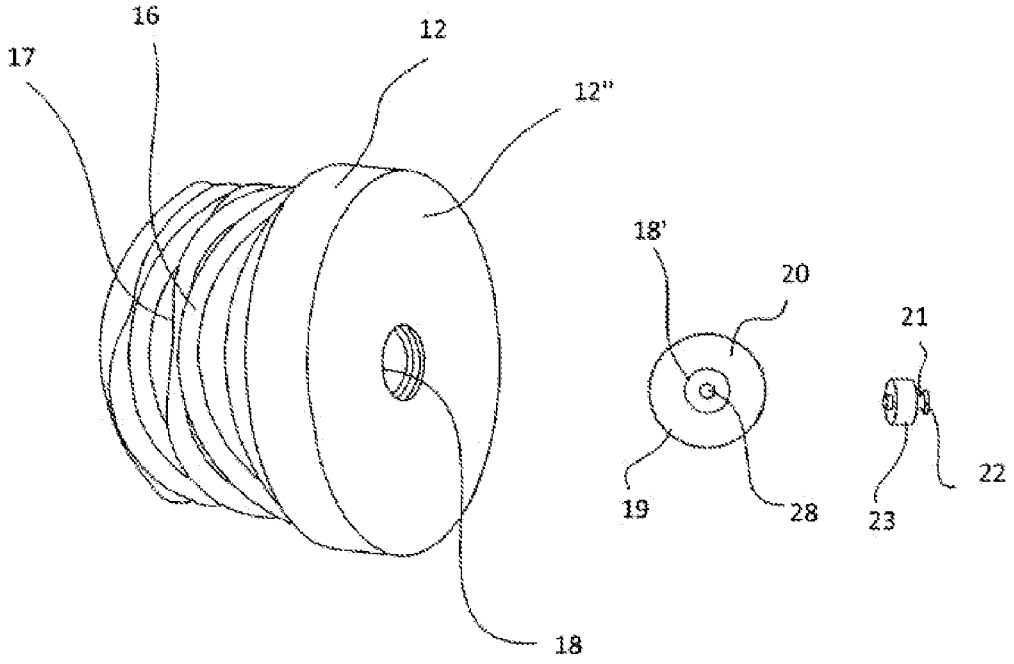
FIG. 4 depicts the punch device represented in FIG. 1 in an exploded view.

The inventive punch device 10 represented in FIGS. 1 to 4 contains a marking element 11 for marking drilled holes to be applied with positional accuracy for the purpose of the positionally accurate positioning of an object to be attached to a wall.

The marking element 11 in this case is transportable reciprocally from a first position, in which the marking element 11 is arranged remotely from the wall, into a second position, in which a front part of the marking element 11 close to the wall makes contact with a point on the wall for the purpose of producing a mark.

The marking element 11 is anchored on a carrier element 13 connected to a carrier frame 12, wherein the carrier element 13 is transportable from the first position into the second position against the force of a spring 14.

In addition, the spring 14 is configured as a helical spring, wherein an end 15 of the helical spring 14 remote from the wall is supported on the carrier frame 12.

The carrier element 13 forms a cylindrical platform arranged on the carrier frame 12, wherein the marking element 11 is arranged at the center of an end face 13' of the carrier element 13 close to the wall, and an end face 13' of the carrier element 13 remote from the wall is securely connected to the carrier frame 12, and wherein the outer surface 13" of the carrier element 13 together with the annular free surface 12' of the likewise cylindrically shaped carrier frame 12 close to the wall forms a support for an end 15 of the helical spring 14 remote from the wall.

The helical spring 14 is formed by a helically wound flat strip, the flat strip being of undulating configuration and in this case having a prescribed elasticity. One end of the flat strip in this case is supported on the carrier frame 12, the other end forming an end face for positioning the punch device 10 on a wall.

In the course of a helical winding through 360°, four successive wave crests 16 and wave troughs 17 are formed, wherein an associated wave trough 17 of a neighboring second winding comprising 360° faces each wave crest 16 of a first winding comprising 360°, and an associated wave crest 16 of a neighboring second winding comprising 360° faces each wave trough 16 of a first winding comprising 360°, in order to obtain an elastic compressibility at a prescribed length of the helical spring 14 by means of the undulation of the flat strip.

The carrier element 13 is executed in a single piece with the carrier frame 12, and an undersurface of the cylindrically shaped carrier frame 12 in this case forms a pressing surface, in order to press the carrier element and the marking element against a wall.

A central drilled hole 18 provided with an internal thread is executed in the region of the undersurface of the carrier frame 12, into which drilled hole a projecting part 18' provided with an external thread of a knurled screw 19 containing a disk 20 is introduced, wherein a distance from the disk 20 to the undersurface of the carrier frame 12 is adjustable by rotation of the knurled screw 19 by hand.

Regions of the disk 20 of the knurled screw 19 remote from the projecting part are provided with a plurality of indentations, in order to permit an easier manual grip.

The disk 20 of the knurled screw 19 has a central drilled hole 28 provided with an internal thread, into which an adjusting screw 21 is introduced, and a compressible elastic silicon tube 23 is arranged between an undersurface of the disk 20 and a head 22 of the adjusting screw 21, wherein a distance from the head 22 of the adjusting screw 21 to the undersurface of the disk 20, and thus the extent of a compression of the silicon tube 23, is adjustable by rotation of the adjusting screw 21 by hand.

Inventive punch devices 100 represented in FIGS. 4 to 9 in each case contain a marking element 110 for marking drilled holes to be applied with positional accuracy for the purpose of the positionally accurate positioning of an object to be attached to a wall 200, which marking element is supported movably in a reciprocal manner, i.e. back and forth, inside a housing 120.

Figure 6:
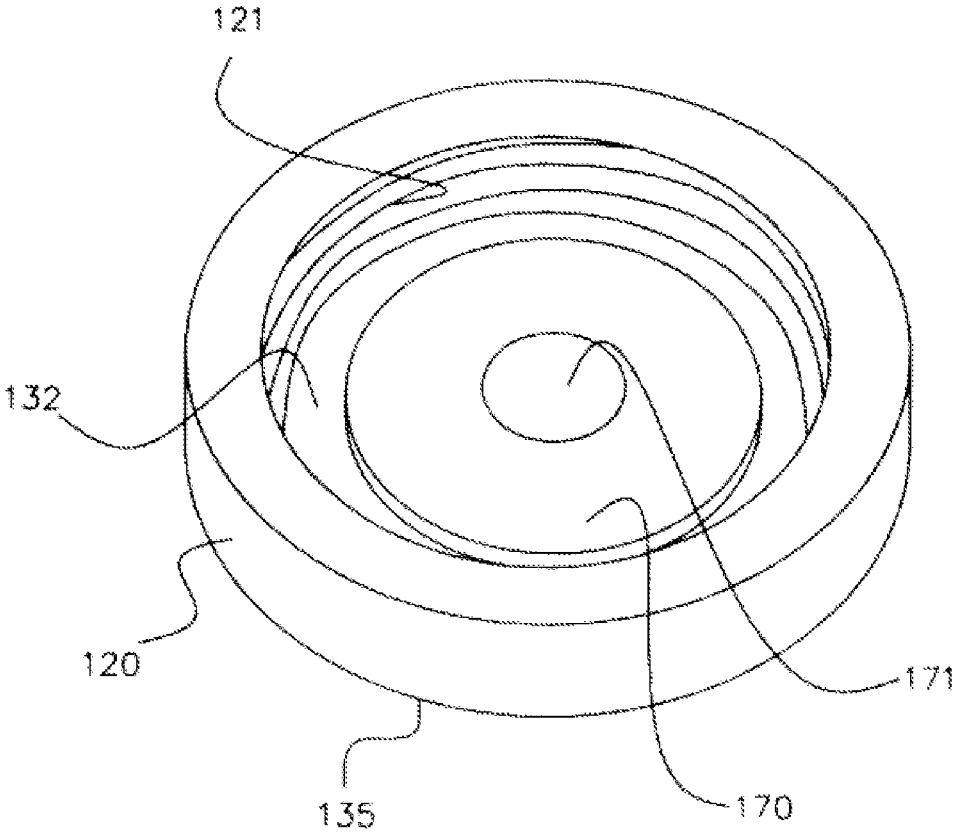
FIG. 6 depicts an embodiment of the inventive punch device representing the housing in an oblique view from above.

This inventive punch device is constructed in principle according to FIG. 6, although unlike the finger spring 160 represented in FIG. 6 it contains two mutually repelling magnets 170, 170'.

A respective housing 120 has a front positioning element 130 close to the wall for positioning the punch device 100 on a wall 200 and is provided with a mounting element 140 provided with a drilled hole 141 for mounting a supporting element 150 connected to the marking element 110.

For the purpose of the releasable anchoring of the supporting element 150, and thus of the punch device 100, to an object in question to be attached to a wall 200, the rear surface of the supporting element 150 remote from the wall 200 is provided with a means for the releasable attachment of the punch device 100 to the object.

The supporting element 150 connected to the marking element 110 is transportable from a first position, in which the marking element 110 at least for the most part is arranged inside the housing 120, into a second position, in which at least a front part of the marking element 110 close to the wall is led through the central opening 131 of the positioning element 130 and protrudes from the housing 120 for the purpose of contacting a point on the wall 200.

The supporting element 150 is preloaded into the first position by means of a spring device formed by two mutually repelling magnets 170, 170' and is transportable into the second position close to the wall by pressing the supporting element 150 against the force of the spring device.

Figure 5:
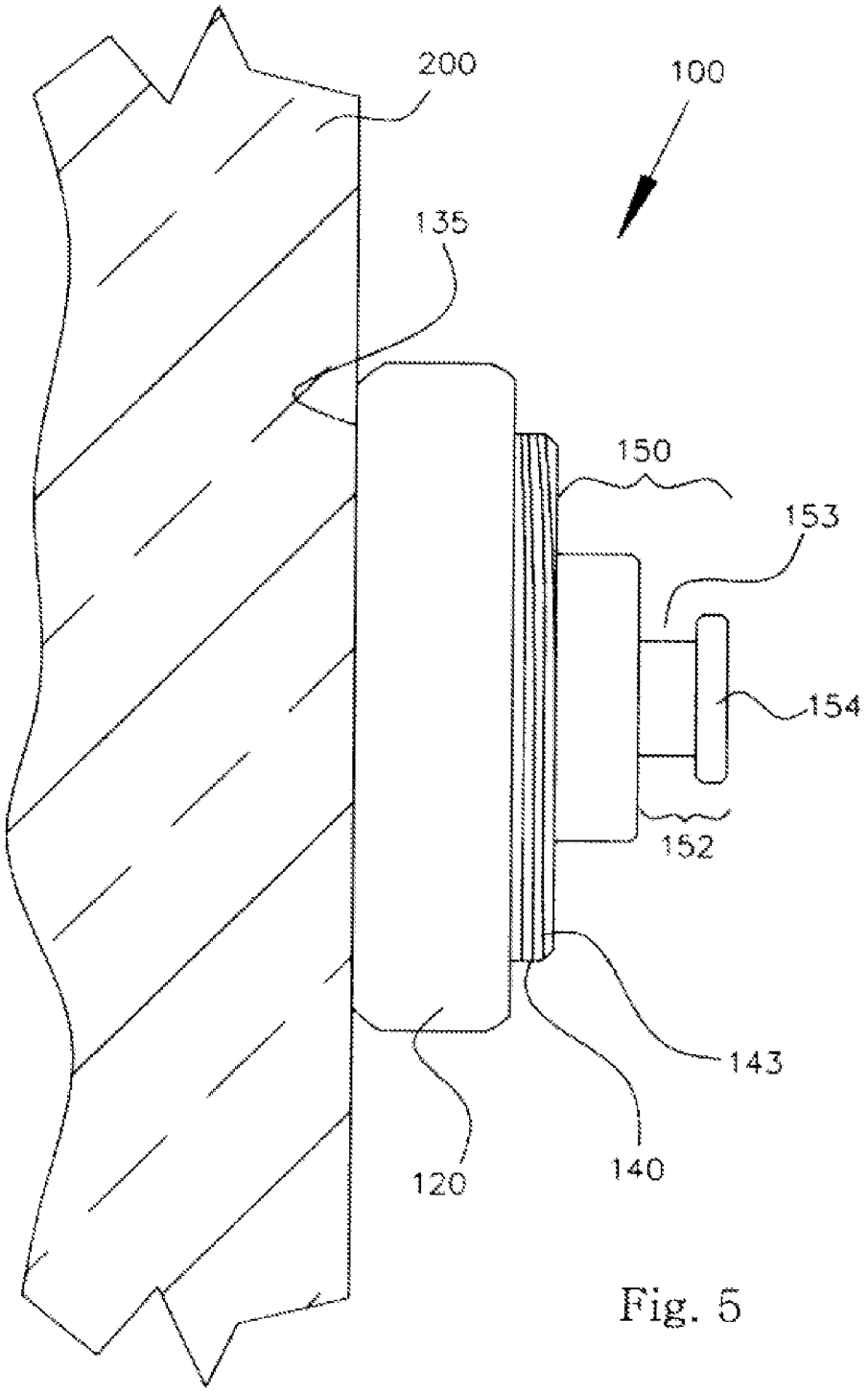
FIG. 5 depicts a first preferred embodiment of the punch device according to the second feature of the present invention in a side view.

In this case, a magnet 170' provided with a central opening 171 as a passage for the reciprocally mounted marking element 110 is positioned in the region of the rear surface 132 of the supporting panel 135 and also, as represented in FIG. 5, in the region of the front end face 151 of the flange 155 of the supporting element 150, wherein the opposing end faces of the two magnets 170, 170' have the same pole designation in order to produce a mutually repelling force forming the spring device.

The supporting element 150 is of bolt-shaped configuration, and the marking element 110 is securely connected to the supporting element 150 in the region of a front end face 151 of the supporting element 150 close to the wall.

Furthermore, the supporting element 150 in the region of the rear end face facing the front end face 151 has an attachment body 152 as a means for the releasable attachment of the supporting element 150 to the object to be attached to the wall 200.

The attachment body 152 for the releasable attachment of the punch device 100 to the object to be attached to the wall 200 is formed by a projecting part 153 positioned in the region of the rear end face of the supporting element 150, which projecting part is provided with a flange 154 for the engagement of the punch device 100 in a cut-out recess of the object to be attached.

The supporting element 150 also has a flange 155 in the region of its front end face 151, of which the rear surface remote from the marking element 110 is supported in the first position of the supporting element 150 on the internal surface of a wall 142 of the mounting element 140 close to the drilled hole 141, configured as an internal flange.

The positioning element 130 is formed by a supporting panel 135 of flat configuration, wherein the front end face 151 of the flange 155 of the supporting element 150 adjoins a rear surface 132 of the supporting panel 135 via the magnets 170, 170' in the second position of the supporting element 150 close to the wall 200.

The housing 120 is substantially of hollow cylindrical configuration and is provided in the region of the internal surface of the cylinder surface in question with an internal thread 121, wherein the mounting element 140 is provided with an external thread 143 corresponding to the internal thread 121 of the housing 120, in order to connect the mounting element 140 releasably to the housing 120 using the supporting element 150.

Figure 10:
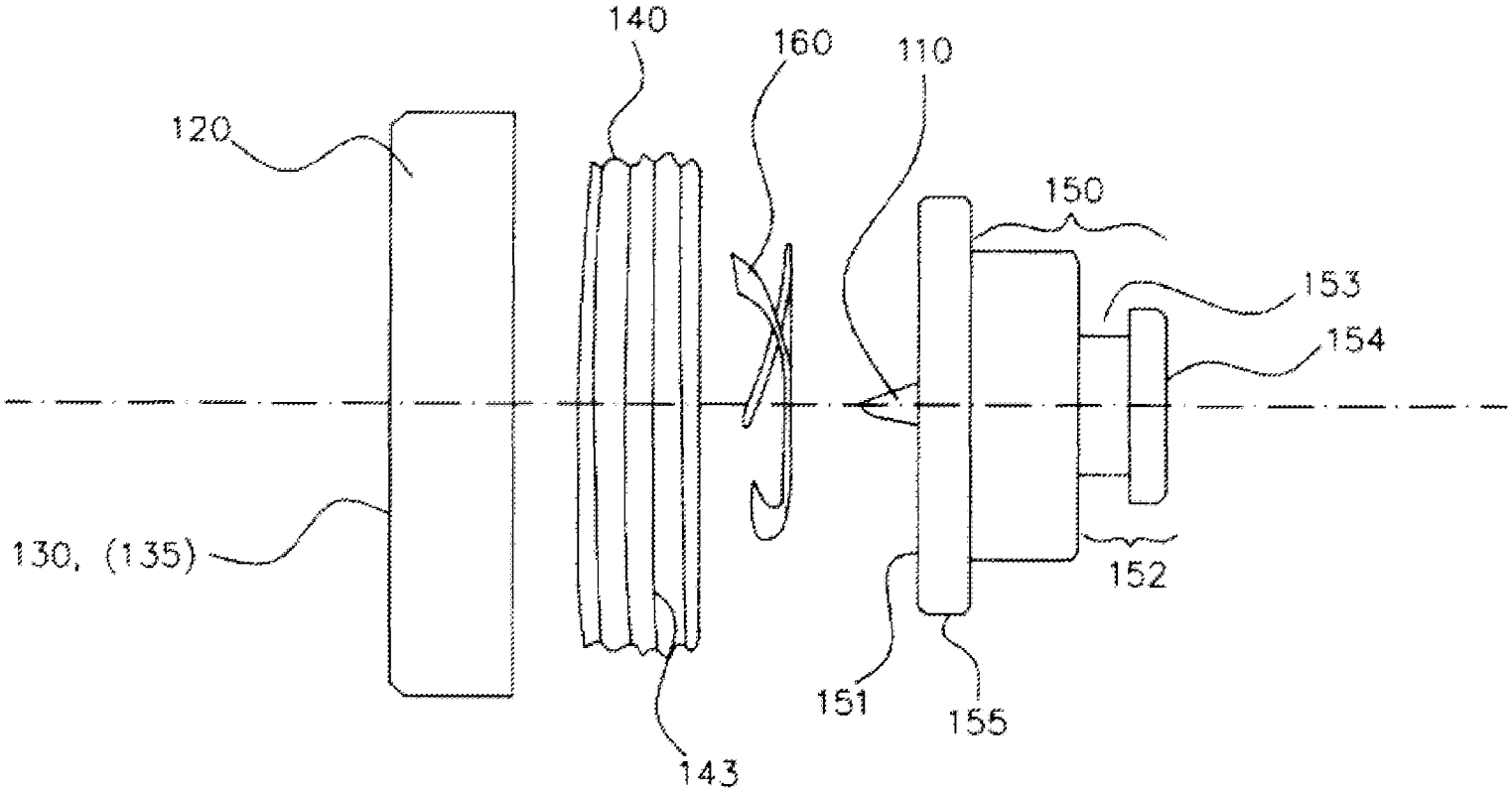
FIG. 10 depicts a second preferred embodiment of the inventive punch device containing a finger spring corresponding to FIG. 10 in an exploded view.
Figure 11:
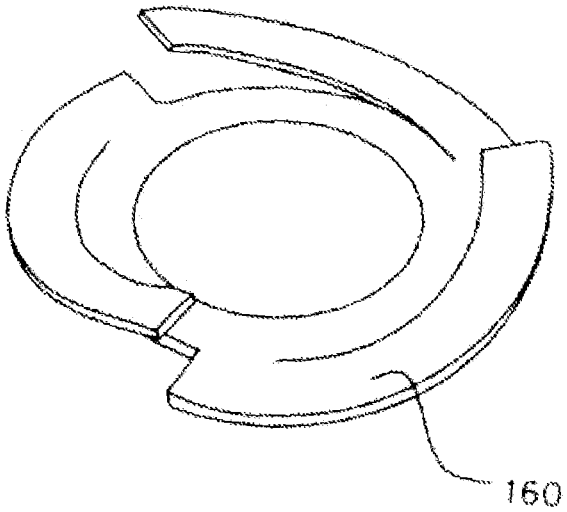
FIG. 11 depicts a spring device of the inventive punch device represented in FIG. 9 embodied as a finger spring in an oblique view from above.

According to the embodiment of the inventive punch device 100 represented in FIGS. 10 and 11 is constructed in principle like that in FIGS. 1 to 5, although it contains a finger spring 160 in place of the magnets 170, 170'.

Figure 7:
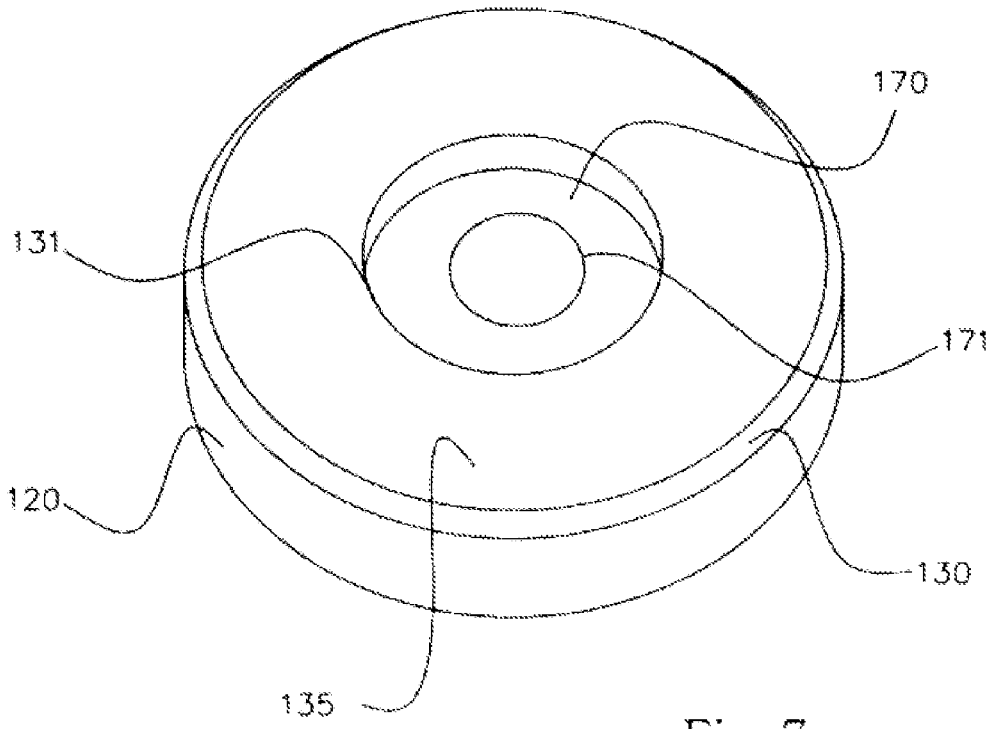
FIG. 7 depicts an embodiment of the inventive punch device representing the housing in an oblique view from below.
Figure 8:
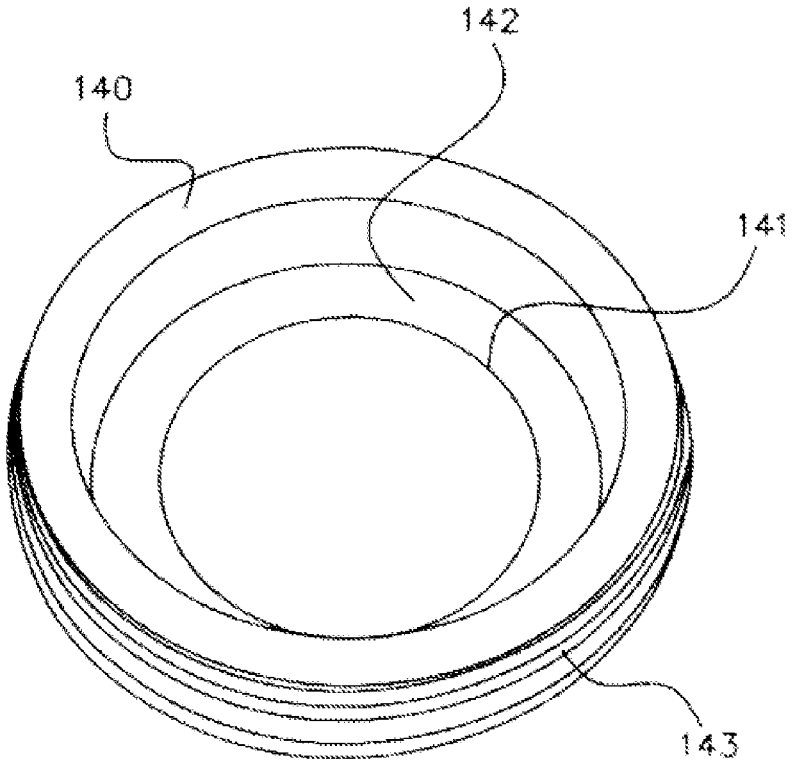
FIG. 8 depicts an embodiment of the inventive punch device representing the mounting element in an oblique view from above.
Figure 9:
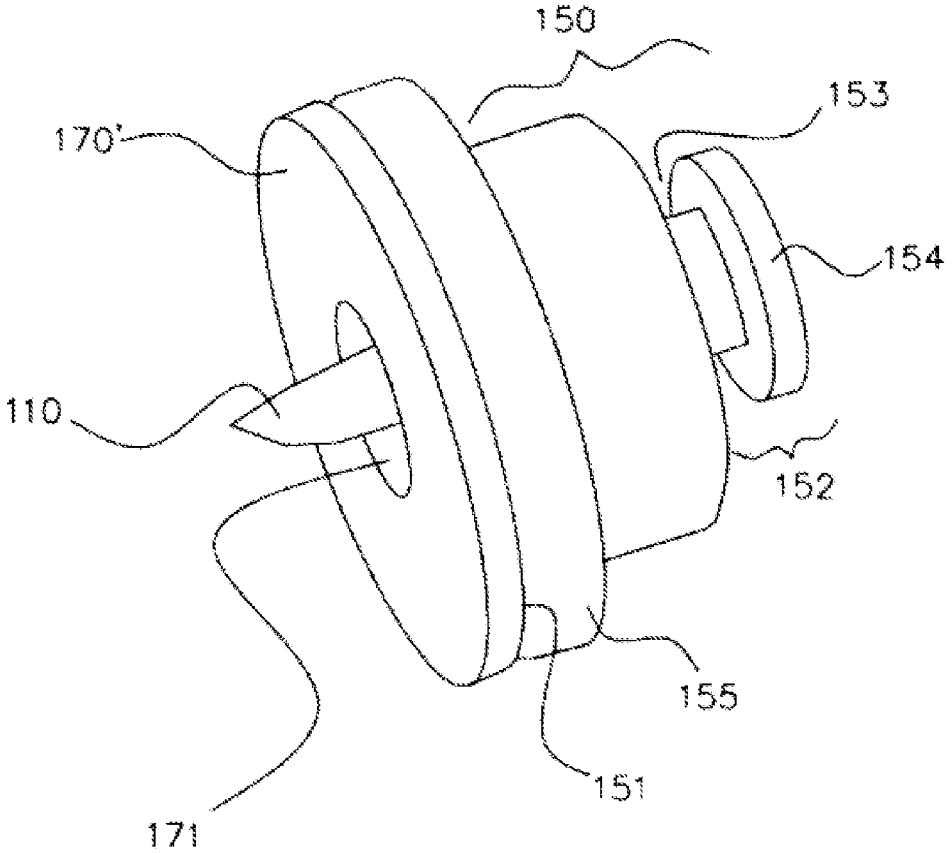
FIG. 9 depicts an embodiment of the inventive punch device representing the supporting element including the magnet in an oblique view from above.

The positioning element 130, on the other hand, is formed by a supporting panel 135 of flat configuration, wherein the front end face 151 of the flange 155 of the supporting element 150 in the second position of the supporting element 150 close to the wall 200 in the embodiment of the inventive punch device 100 represented in FIG. 6 indirectly, since via the annular spring executed as a finger spring 160 adjoins a rear surface 132 of the supporting panel 135. The finger spring 160 in this case is represented in FIG. 7 in an oblique view from above.

The marking element 110 in each case is formed by a felt-tipped marker, of which the tip is configured in order, in a second position of the supporting element 150, to apply a marking point to a wall 200, which marking point determines the point on the wall 200, at which a drilled hole for the introduction of a screw or of a dowel for the attachment of an object in question on the wall 200 is to be inserted into the wall 200.

The illustrative embodiment of the invention described above serves only for the purpose of a better understanding of the inventive characterizing features prescribed by the claims, which are not as such restricted by the illustrative embodiment.

LIST OF REFERENCE DESIGNATIONS

10=punch device
11=marking element
12=carrier frame
12'=surface of the carrier frame close to the wall
12"=undersurface of the carrier frame
13=carrier element
13'=end face of the carrier element close to the wall
13"=outer surface of the carrier element
14=spring
15=end of the spring remote from the wall
16=wave crest
17=wave trough
18=central drilled hole of the carrier frame
18'=projecting part of the knurled screw
19=knurled screw
20=disk
20'=undersurface of the disk of the knurled screw
21=adjusting screw
22=head
23=silicon tube
28=central drilled hole of the knurled screw
100=punch device
110=marking element
120=housing
121=internal thread
130=positioning element
135=supporting panel
131=central opening
132=rear surface
140=mounting element
141=drilled hole
142=wall
143=external thread
150=supporting element
151=front end face
152=attachment body
153=projecting part
154=flange
155=flange
160=finger spring
170=magnet
170'=magnet
171=central opening
200=wall

The invention claimed is:

1. Punch device with a marking element for marking drilled holes to be applied with positional accuracy for the purpose of the positionally accurate positioning of an object to be attached to a wall, wherein:

the marking element is transferable reciprocally from a first position, in which the marking element is arranged remotely from the wall, into a second position, in which a front part of the marking element close to the wall makes contact with a point on the wall for the purpose of producing a mark;

the marking element is at least partially reciprocally mounted inside a housing, which is provided with a front positioning element provided with a central opening close to the wall for positioning the punch device on the wall, as well as with a mounting element provided with a drilled hole for mounting a supporting element connected to the marking element, which has a means for the releasable attachment of the mounting element to the housing;

the supporting element connected to the marking element is transportable from a first position, in which the marking element is at least partially arranged inside the housing, into a second position, in which at least a front part of the marking element close to the wall is led through the central opening of the positioning element and protrudes from the housing for the purpose of contacting a point on the wall;

the supporting element is preloaded in the first position by means of a spring device interacting with a rear surface of the positioning element and is transferable into the second position by pressing the supporting element against the force of the spring device;

the supporting element is of bolt-shaped configuration; and the marking element is securely connected to the supporting element in the region of a front-end face of the supporting element close to the wall.

2. Punch device according to claim 1, characterized in that the supporting element in the region of the rear end face facing the front end face has an attachment body.

3. Punch device according to claim 1, characterized in that the supporting element in the region of its front end face has a flange, of which the rear surface remote from the marking element is supported in the first position of the supporting element on the internal surface of a wall of the mounting element close to the drilled hole and embodied as an internal flange.

4. Punch device according to claim 3, characterized in that the positioning element is formed by a supporting panel of flat configuration.

5. Punch device according to claim 4, characterized in that the front end face of the flange of the supporting element adjoins a rear surface of the supporting panel at least indirectly in the second position of the supporting element.

* * * * *